US011753773B2

(12) United States Patent
Tuszkiewicz et al.

(10) Patent No.: US 11,753,773 B2
(45) Date of Patent: Sep. 12, 2023

(54) PAPERBOARD PRODUCT

(71) Applicants: General Mills, Inc., Minneapolis, MN (US); University of Maine System Board of Trustees, Bangor, ME (US)

(72) Inventors: George Tuszkiewicz, Plymouth, MN (US); Matthew W Lorence, Plymouth, MN (US); Mark Paradis, Old Town, ME (US); Michael A Bilodeau, Brewer, ME (US)

(73) Assignees: General Mills, Inc., Minneapolis, MN (US); University of Maine System Board of Trustees, Bangor, ME (US)

( * ) Notice: Subject to any disclaimer, the term of this patent is extended or adjusted under 35 U.S.C. 154(b) by 479 days.

(21) Appl. No.: 16/850,552

(22) Filed: Apr. 16, 2020

(65) Prior Publication Data

US 2020/0240087 A1 Jul. 30, 2020

Related U.S. Application Data

(63) Continuation of application No. 15/768,098, filed as application No. PCT/US2015/055939 on Oct. 16, 2015, now Pat. No. 10,669,675.

(51) Int. Cl.

| | |
|---|---|
| ***D21J 1/08*** | (2006.01) |
| ***D21H 21/22*** | (2006.01) |
| ***D21H 27/30*** | (2006.01) |
| ***D21H 17/09*** | (2006.01) |
| ***D21H 19/14*** | (2006.01) |
| ***D21J 1/00*** | (2006.01) |
| ***D21H 17/28*** | (2006.01) |

(Continued)

(52) U.S. Cl.

CPC ..... *D21J 1/08* (2013.01); *D21H 11/00* (2013.01); *D21H 17/09* (2013.01); *D21H 17/25* (2013.01); *D21H 17/28* (2013.01); *D21H 19/14* (2013.01); *D21H 19/34* (2013.01); *D21H 21/18* (2013.01); *D21H 21/22* (2013.01); *D21H 27/30* (2013.01); *D21J 1/00* (2013.01)

(58) Field of Classification Search

None

See application file for complete search history.

(56) References Cited

U.S. PATENT DOCUMENTS

| | | | |
|---|---|---|---|
| 3,320,080 | A | 5/1967 | Mazzarella et al. |
| 3,947,315 | A | 3/1976 | Smith |

(Continued)

FOREIGN PATENT DOCUMENTS

| | | |
|---|---|---|
| WO | WO 2013/160553 | 10/2013 |
| WO | WO 2014/105647 | 7/2014 |

(Continued)

OTHER PUBLICATIONS

Safety Data Sheet, "*Bleached Kraft Pulp*", Weyerhaeuser SDS WC S186-23 (M), pp. 1-7, Rev. Aug. 24, 2015.

*Primary Examiner* — Dennis R Cordray

(74) *Attorney, Agent, or Firm* — Diederiks & Whitelaw, PLC; John L. Crimmins, Esq.

(57) ABSTRACT

The present disclosure relates to paperboard having an improved basis weight to bending strength relationship and methods of making paperboard having an improved basis weight to bending strength relationship. In particular, a paperboard provided herein includes a refined cellulose in at least 1 ply.

7 Claims, 9 Drawing Sheets

(51) Int. Cl.

| | |
|---|---|
| ***D21H 19/34*** | (2006.01) |
| ***D21H 21/18*** | (2006.01) |
| ***D21H 11/00*** | (2006.01) |
| ***D21H 17/25*** | (2006.01) |

(56) References Cited

U.S. PATENT DOCUMENTS

| | | | |
|---|---|---|---|
| 4,443,297 | A | 4/1984 | Cheshire et al. |
| 4,488,932 | A | 12/1984 | Eber et al. |
| 4,498,956 | A | 2/1985 | Cheshire et al. |
| 4,543,156 | A | 9/1985 | Cheshire et al. |
| 4,596,660 | A | 6/1986 | Hou |
| 4,913,773 | A | 4/1990 | Knudsen et al. |
| 5,178,729 | A | 1/1993 | Janda |
| 5,725,733 | A | 3/1998 | Brandauer et al. |
| 5,955,014 | A | 9/1999 | Raukola et al. |
| 6,103,060 | A | 8/2000 | Munerelle et al. |
| 6,413,368 | B1 | 7/2002 | Dwiggins et al. |
| 6,444,088 | B2 | 9/2002 | Rökman et al. |
| 6,582,553 | B2 | 6/2003 | Jewell et al. |
| 7,381,298 | B2 | 6/2008 | Schwonke |
| 8,752,776 | B2 | 6/2014 | Dean et al. |
| 9,017,803 | B2 | 4/2015 | Anderson et al. |
| 9,458,570 | B2 | 10/2016 | Jabar, Jr. et al. |
| 9,816,233 | B2 | 11/2017 | Shi et al. |
| 10,669,675 | B2 * | 6/2020 | Tuszkiewicz ..... D21H 17/25 |
| 2002/0088579 | A1 | 7/2002 | Forsberg et al. |
| 2005/0067124 | A1 | 3/2005 | Satyavolu |
| 2007/0215301 | A1 | 9/2007 | Bunker et al. |
| 2009/0199349 | A1 | 8/2009 | Weinstein |

FOREIGN PATENT DOCUMENTS

| | | |
|---|---|---|
| WO | WO 2015/173474 | 11/2015 |
| WO | WO 2013/160564 | 10/2016 |

* cited by examiner

PAPERBOARD PRODUCT

CROSS-REFERENCE TO RELATED APPLICATIONS

This application represents continuation application of application Ser. No. 15/768,098, filed Apr. 13, 2018, entitled "Paperboard Product" which is a National Stage application of PCT/US2015/055939 filed Oct. 16, 2015 and titled "Paperboard Product". The entire content of these applications is incorporated by reference.

TECHNOLOGY

The present disclosure generally relates to paper products and methods for producing paper products.

BACKGROUND

Many products are packaged in paperboard packaging. Paperboard provides a relatively light weight and inexpensive packaging material while still protecting sensitive products, such as food, from damage.

In an effort to reduce the impact of the use of paperboard materials on forests, some packaging is made partly or entirely from cellulose from recycled materials. However, cellulose from recycled materials loses strength each time it is recycled, resulting in a paperboard that can have reduced bending stiffness compared to paperboard made from virgin cellulose. In some cases, some bending stiffness can be regained by increasing the thickness of paperboard made from recycled materials or adding virgin cellulose.

SUMMARY

Provided herein is a paper product suitable for packaging, such as a paperboard product, that can have an increased bending stiffness, compressive resistance, and/or compressive resistance than expected from its basis weight.

In one embodiment, a paperboard product is provided herein that includes 1 or more plies, where the cellulose content of each of the 1 or more plies includes cellulose from a paper furnish at about 80% to about 100% by weight, with at least 1 ply of the 1 or more plies including a bond strengthening agent and a refined cellulose in an amount of about 5% to about 20% by weight of the cellulose content of the at least 1 ply, and where the paperboard product has a basis weight reduction of about 5% to about 30%, a bending stiffness of at least 90%, and a thickness of about 90% to about 110% of a control paperboard having a single ply with a cellulose content that is 100% cellulose from the paper furnish. In some embodiments, the paperboard product also has a compressive resistance of at least 90% of the control paperboard.

In another embodiment, a paperboard product is provided herein that includes 1 or more plies, where the cellulose content of each of the 1 or more plies includes cellulose from a paper furnish at about 80% to about 100% by weight, with at least 1 ply of the 1 or more plies including a bond strengthening agent and a refined cellulose in an amount of about 5% to about 20% of the cellulose content of the at least 1 ply, where the paperboard product has a basis weight of about 90% to about 110%, a bending stiffness of at least 115%, and a thickness of about 95% to about 105% of a control paperboard having a single ply with a cellulose content that is 100% cellulose from the paper furnish. In some embodiments, the paperboard product also has a compressive resistance of at least 115% of the control paperboard.

In another embodiment, a paperboard product is provided herein that includes 1 or more plies, where the cellulose content of each of the 1 or more plies includes cellulose from a paper furnish at about 80% to about 100% by weight, with at least 1 ply of the 1 or more plies including a bond strengthening agent and a refined cellulose in an amount of about 5% to about 20% by weight of the cellulose content of the at least 1 ply, and where the paperboard product has a basis weight reduction of about 5% to about 30%, a compressive resistance of at least 90%, and a thickness of about 90% to about 110% of a control paperboard having a single ply with a cellulose content that is 100% cellulose from the paper furnish.

In another embodiment, a paperboard product is provided herein that includes 1 or more plies, where the cellulose content of each of the 1 or more plies includes cellulose from a paper furnish at about 80% to about 100% by weight, with at least 1 ply of the 1 or more plies including a bond strengthening agent and a refined cellulose in an amount of about 5% to about 20% of the cellulose content of the at least 1 ply, where the paperboard product has a basis weight of about 90% to about 110%, a compressive resistance of at least 115%, and a thickness of about 95% to about 105% of a control paperboard having a single ply with a cellulose content that is 100% cellulose from the paper furnish.

In some embodiments, the refined cellulose can include highly refined wood cellulose or refined oat hulls. In some embodiments, the highly refined wood cellulose can be included in the at least 1 ply in an amount of about 5% to 10% of the cellulose content of the at least one ply. In some embodiments, the refined oat hulls can be included in the at least 1 ply in an amount of about 5% to about 15% of the cellulose content of the at least 1 ply. In some embodiments, the refined cellulose can be refined oat hulls and the bond strengthening agent can be highly refined wood cellulose in a 3:1 to 4:1 ratio of refined oat hulls to highly refined cellulose.

In some embodiments, the combined cellulose content of all of the 1 or more plies can be from about 5% to about 20% by weight refined cellulose.

In some embodiments, the paper furnish can be a recycled furnish.

In some embodiments, the at least 1 ply can be foam formed.

In some embodiments, the bond strengthening agent can include a non-cellulose polymer in an amount of about 1% to about 8% by weight of the at least 1 ply. A non-cellulose polymer can include a starch.

In some embodiments, a paperboard product can include a top ply, a middle ply, and a bottom ply, wherein at least the middle ply includes the refined cellulose and the bond strengthening agent.

In some embodiments, an outer surface of the paperboard product can be coated with a polyelectrolyte complex. A polyelectrolyte complex can include starch, carboxymethyl cellulose, or a combination thereof.

Also provided herein is a method of making a paperboard product. In an embodiment, the method includes depositing a layer of a suspension of cellulose fibers, the suspension including a bond strengthening agent and having a cellulose content of about 80% to about 95% cellulose from a paper furnish and about 5% to about 20% refined cellulose; and applying pressure to the layer to form at least 1 ply of a paperboard product having 1 or more plies, where the paperboard product has a basis weight reduction of 5% to 30%, a bending stiffness of at least 90%, and a thickness of about 90% to about 110% of a control paperboard having a single ply with a cellulose content that is 100% cellulose from the paper furnish. In some embodiments, the paperboard product also has a compressive resistance of at least 90% of the control paperboard.

In another embodiment, the method includes depositing a layer of a suspension of cellulose fibers, the suspension including a bond strengthening agent and having a cellulose content of about 80% to about 95% cellulose from a recycled furnish and about 5% to about 20% refined cellulose; and applying pressure to the layer to form at least 1 ply of a paperboard product having 1 or more plies, wherein the paperboard product has a basis weight of about 90% to about 110%, a bending stiffness of at least 115%, and a thickness of about 95% to about 105% of a control paperboard having a single ply with a cellulose content that is 100% cellulose from the paper furnish. In some embodiments, the at least 1 ply also has a compressive resistance of at least 115% of the control paperboard.

In another embodiment, the method includes depositing a layer of a suspension of cellulose fibers, the suspension including a bond strengthening agent and having a cellulose content of about 80% to about 95% cellulose from a paper furnish and about 5% to about 20% refined cellulose; and applying pressure to the layer to form at least 1 ply of a paperboard product having 1 or more plies, where the paperboard product has a basis weight reduction of 5% to 30%, a compressive resistance of at least 90%, and a thickness of about 90% to about 110% of a control paperboard having a single ply with a cellulose content that is 100% cellulose from the paper furnish.

In another embodiment, the method includes depositing a layer of a suspension of cellulose fibers, the suspension including a bond strengthening agent and having a cellulose content of about 80% to about 95% cellulose from a recycled furnish and about 5% to about 20% refined cellulose; and applying pressure to the layer to form at least 1 ply of a paperboard product having 1 or more plies, wherein the paperboard product has a basis weight of about 90% to about 110%, a compressive resistance of at least 115%, and a thickness of about 95% to about 105% of a control paperboard having a single ply with a cellulose content that is 100% cellulose from the paper furnish.

In some embodiments, the refined cellulose includes highly refined wood cellulose or refined oat hulls.

In some embodiments, the bond strengthening agent comprises a non-cellulose polymer.

In some embodiments, the paper furnish is a recycled furnish.

In some embodiments, the suspension is a foam.

In some embodiments, a method provided herein further includes coating the paperboard product with a polyelectrolyte complex.

These and various other features and advantages will be apparent from a reading of the following detailed description.

DETAILED DESCRIPTION

Figure 1:
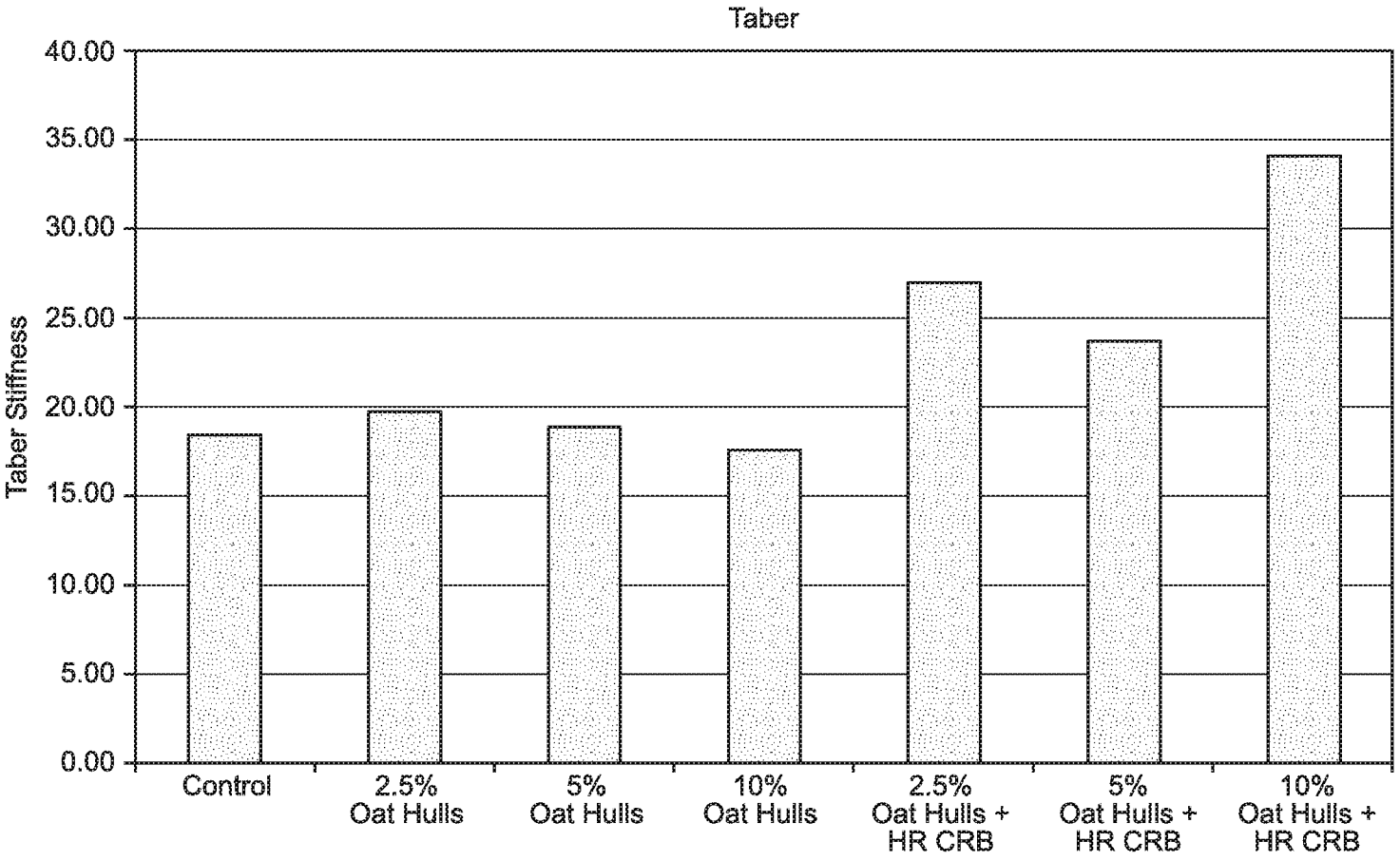
FIG. 1 shows bending stiffness measured by Taber Stiffness of paperboard samples including refined cellulose as compared to a control that does not include refined cellulose.

The use of recycled cellulose has reduced the demand for virgin materials that can contribute to deforestation. However, recycled cellulose loses strength with subsequent recycling due to reduced bonding potential between fiber particles, resulting in a decline in physical properties, such as bending stiffness as measured by Taber stiffness and compressive resistance as measured by STFI edgewise strength test, of paperboard made with recycled cellulose. In order to retain bending stiffness of paperboard packaging made with recycled cellulose, some virgin cellulose material can be included in the furnish used to make the paperboard. In some cases, because increased thickness, or caliper, of a paperboard positively impacts bending stiffness thickness of paperboard, caliper can be increased to offset a reduced internal bonding. In some cases polymers, such as starch, are added to the furnish in order to increase internal bonding of the cellulose fibers and increase paperboard strength.

However, these solutions increase the basis weight of the paperboard, making it heavier per unit of area. Increased paperboard basis weight can negatively impact the environment by increasing fuel usage to transport the paperboard prior to its use in packaging, as well as afterward as a result in increased weight of the final package and packaged product. Further, the demand for recycled cellulose has increased, resulting in a shrinking supply of recycled cellulose. In the face of shrinking supply of recycled cellulose, more virgin materials are harvested to supplement the reduced supply. Thus, it is not desirable to address the reduced strength of paperboard made with recycled cellulose by increasing the thickness with additional recycled cellulose content.

In light of the challenges facing the use of recycled cellulose in paperboard packaging, the inventors sought a way to retain physical properties that are important for paperboard packaging, such as bending stiffness (as measured by Taber stiffness) or compressive resistance (as measured by STFI edgewise strength), while reducing the amount of cellulosic material included in a paperboard made with recycled cellulose. It was discovered that by reducing the density of at least 1 ply of a paperboard having 1 or more plies and replacing some of the recycled cellulose content with a refined cellulose and adding a bond strengthening agent, the basis weight can be reduced while maintaining a similar or higher caliper and similar or higher bending stiffness or a similar or higher compressive resistance. It was also discovered that bending stiffness can be further increased by coating one or both surfaces of the paperboard with, for example, a polyelectrolyte complex. The disclosed concept can also be applied to paperboards that include virgin cellulose in order to reduce basis weight, or increase bending stiffness or compressive resistance, and reduce the overall use of virgin cellulose. In addition, it is to be understood that, while the disclosed concepts are applied to paperboards, they may also be applied to other paper products useful for packaging, such as one or more of the liner and medium of corrugated board, in order to reduce basis weight and/or increase bending stiffness or edge crush resistance (edge crush resistance as measured using American Society for Testing and Materials (ASTM) D5639). Further, while a typical paperboard product has a thickness of from 0.012 inch to 0.040 inch, the concepts provided herein can be used to reduce basis weight and/or increase bending stiffness of paper products having thicknesses outside that range.

A paperboard product provided herein includes one or more plies (e.g., 1 to 7 plies), where at least one of the plies has a cellulose content that is from about 5% to about 20% (e.g., about 5% to about 15% or about 5% to about 10%) refined cellulose. As used herein, the term "refined cellulose" refers to a highly refined wood cellulose or a refined non-wood cellulose, having a particle size of from about 200 μm to about 500 μm in length and about 20 μm to about 40 μm in width. The refined cellulose suitable for use in a paperboard product contrasts with microfibrillated cellulose (MFC) or cellulose nanofibers (CNF), which typically have a particle size that ranges from about 2 nm to about 40 nm in width and from about 10 μm up to several mm in length. Refined cellulose suitable for use in a paperboard product provided herein provides at least one benefit over MFC or CNF in that it is less hydrophilic, which allows incorporation of the refined cellulose in an amount of about 5% to about 20% by weight of the cellulose content without significantly reducing water drainage or increasing drying time during manufacture of the paperboard product.

A highly refined wood cellulose is a wood cellulose that has been processed by mechanical processing to produce cellulose fibers that have a length of about 300 μm to about 500 μm and diameter of about 20 μm to about 30 μm. It is to be understood that a highly refined wood cellulose does not necessarily exclude the occasional fiber that is longer than 500 μm or wider than 30 μm. Generally, a highly refined wood cellulose has a shorter average fiber length than wood cellulose from a paper furnish source, such as a recycled furnish. For example, a coated recycled paperboard furnish typically has cellulose that has fibers that are about 600 μm to about 800 μm in length and about 20 μm to about 30 μm in width. A highly refined wood cellulose can be made from virgin or recycled wood cellulose sources.

A refined non-wood cellulose can be obtained by mechanically processing a non-wood cellulose source (e.g., oat hulls, switch grass, corn stalks, and the like) to produce particles that are about 200 μm to about 400 μm in length and about 30 μm to about 40 μm in width. As with highly refined wood cellulose, it is to be understood that a refined non-wood cellulose does not necessarily exclude the occasional particle that is larger than 400 μm in length or 40 μm in width.

Mechanical processing of a cellulose source to produce a refined cellulose can include any mechanical process, such as cutting, tearing, milling, or grinding of the cellulose source to produce the desired particle size. For example, a process suitable for making both highly refined wood cellulose and refined non-wood cellulose includes the use of milling plates to mill cellulose into the desired size.

In some embodiments, a refined cellulose can be selected to utilize readily available or conveniently located materials. For example, oat hulls are a particularly attractive non-wood cellulose source for a refined non-wood cellulose for General Mills because General Mills mills and uses a large volume of oats.

In some embodiments, refined cellulose included in at least one ply of a paperboard product provided herein can be a combination of a highly refined wood cellulose and a refined non-wood cellulose. The ratio of refined non-wood cellulose and highly refined cellulose can be selected to provide a desired benefit based on physical properties of the selected refined cellulose sources, the costs of the refined cellulose sources, the availability of the refined cellulose sources, and the like. Selected combinations can be used to provide benefits such as a desired basis weight, a desired drainage rate, a desired bending strength of the paperboard, a desired cost, and the like. For example, a refined cellulose that is about 50% to about 90% (e.g., about 65% to about 85%, or about 75%) refined oat hulls and about 10% to about 50% (e.g., about 20% to about 30%, or about 25%) highly refined wood cellulose can be included in at least one ply of a paperboard product. Other suitable ratios of refined non-wood cellulose to highly refined wood cellulose include about 2:1 to about 5:1, or from about 3:1 to about 4:1. This combination has been found to provide a surprising balance of drainage, which can increase production line efficiency of the paperboard product, and bending strength.

In addition to the cellulose content provided by a refined cellulose, the remaining cellulose content in a paperboard product provided herein can be from any appropriate paper furnish. Each ply of a paperboard product provided herein includes a cellulose content of about 80% to about 100% by weight from a paper furnish. In some embodiments, all of the plies contain some refined cellulose. In some embodiments, one or more plies contain no refined cellulose. In some embodiments, while at least 1 ply contains a cellulose content that is about 5% to about 20% by weight refined cellulose, one or more ply can contain some amount of refined cellulose less than 5% by weight of the cellulose content. In such embodiments, the total cellulose content of a paperboard product provided herein can be about 5% to about 20% refined cellulose.

As used herein, the term "paper furnish" refers to a cellulose suspension in water suitable for making paper or paperboard. A paper furnish can include wood or non-wood cellulose, and the cellulose content of a paper furnish can include cellulose from a virgin source (i.e., cellulose that was not previously used to produce a paper product) or cellulose from a recycled source. Paper furnish is referred to herein by the type of paper or paperboard it is formulated to produce. Paper furnishes that include cellulose from a virgin source include, for example, coated natural kraft (CNK) and solid bleached sulfate (SBS). A recycled furnish includes cellulose that has been recovered from a used paper source (e.g., old newspaper (ONP), old corrugated containers (OCC), office clippings), but may also include some portion of cellulose from a virgin source. Thus, cellulose from a recycled furnish need not be 100% recycled. Recycled furnishes include, for example, recycled paperboard and coated recycled paperboard (CRB), and a combination thereof.

A paper furnish can include additional components, such as colorants (e.g., dyes, optical brighteners), fillers (e.g., calcium carbonate, clay), and sizers (e.g., resins, starch). In some embodiments, a paper furnish can also include a foaming agent (e.g., ammonium lauryl sulfate, sodium lauryl sulfate, alkyl-ether sulfates, sodium laureth sulfate, alkyl polyethylene glycol ethers, sodium myreth sulfate, or sodium dodecyl sulfate).

For the purposes of clarity, a "paper furnish" herein refers to a cellulose suspension that does not contain a refined cellulose unless specifically indicated as including refined cellulose.

A paperboard product provided herein also contains a bond strengthening agent in the at least one ply having a cellulose content of about 5% to about 20% by weight refined cellulose. It is believed that the relatively small particle size of the refined cellulose increases the contact area per volume of the particles. The increased contact area can facilitate network bonding of the cellulose in the ply by the bond strengthening agent without close contact of the cellulose particles, allowing the at least 1 ply containing refined cellulose to have a reduced basis weight compared to a similarly prepared ply that does not contain refined cellulose.

Bond strengthening agents suitable for use in a paperboard product provided herein include any composition that facilitates bonding of cellulose fibers during the papermaking process. For example, various non-cellulose polymers (e.g., starch, charged ionic starch or other modified starch, hydroxymethylcellulose, hydroxyethylcellulose, acrylamide polymers, poly(acrylamide/acrylic acid), glyoxylated polyacrylamide, polyaminoamide-epichlorohydrin, and combinations thereof) can be used as bond strengthening agents.

In some embodiments, a bond strengthening agent can be a refined cellulose when combined with another refined cellulose. For example, a highly refined wood cellulose can function as a bond strengthening agent when combined with a refined non-wood cellulose. A refined cellulose used as a bond strengthening agent contributes to the refined cellulose content of a paperboard ply. In some embodiments, a refined cellulose bond strengthening agent can also be combined with one or more additional bond strengthening agents, such as a non-cellulose polymer.

The type and amount of bond strengthening agent included in a paperboard product provided herein can be selected in order to contribute to desired paper properties, such as tear strength, bending stiffness, compressive resistance, edge crush resistance, or z-bond without significantly affecting basis weight. In some embodiments, the type and amount of bond strengthening agent included in a paperboard product can be selected in order to reduce the amount of contamination of white water by the bond strengthening agent during manufacture of the paperboard product. For example, a non-cellulose polymer bond strengthening agent can be included in the at least one ply in an amount of from about 1% to about 8% (e.g., about 2% to about 6%) by weight of the at least one ply.

A combination of a cellulose content of about 5% to about 20% by weight refined cellulose and a bond strengthening agent can provide one or more advantages when included in at least 1 ply of a paperboard having one or more plies. For example, a paperboard product having at least one ply having a cellulose content of about 5% to about 20% by weight refined cellulose and containing a bond strengthening agent can be made to have the same or similar caliper, while having a reduced basis weight and a similar or greater bending stiffness or similar or greater compressive resistance compared to a control paperboard having a single ply with a cellulose content that is 100% cellulose from a paper furnish. In some embodiments, a paperboard having at least one ply that has a cellulose content of about 5% to about 20% by weight refined cellulose and about 80% to about 95% cellulose from a paper furnish, and containing a bond strengthening agent can have a basis weight reduction of about 5% to about 30% (e.g., about 10% to about 25%, or about 15% to about 25%), a bending stiffness of at least 90% (e.g., at least 100%, or at least 105%) and/or compressive resistance of at least 90% (e.g., at least 100%, or at least 105%), and a caliper of about the same thickness (e.g., from about 90% to about 110%) of a control paperboard having a single ply with a cellulose content that is 100% cellulose from the same paper furnish.

In another example, a paperboard product including at least one ply containing about 5% to about 20% by weight refined cellulose and a bond strengthening agent can be made to have the same or similar basis weight, while having the same or similar caliper and a greater bending stiffness and/or compressive resistance compared to a control paperboard having a single ply with a cellulose content that is 100% cellulose from a paper furnish. In some embodiments, a paperboard product including at least one ply that has a cellulose content of about 5% to about 20% by weight refined cellulose and about 80% to about 95% cellulose from a paper furnish, and containing a bond strengthening agent can have a basis weight that is about the same (e.g., from about 90% to about 110%, or about 98% to about 105%), a bending stiffness that is at least 115% (e.g., at least 120%, or at least 125%) and/or compressive resistance of at least 110% (e.g., at least 115%, or at least 120%), and a caliper of about the same thickness (e.g., from about 95% to about 105%) of a control paperboard having a single ply with a cellulose content that is 100% cellulose from the same paper furnish.

In another example, a paperboard product including at least one ply containing about 5% to about 20% by weight refined cellulose and a bond strengthening agent can be made to have the same or similar basis weight, while having a greater caliper and a greater bending stiffness and/or compressive resistance compared to a control paperboard having a single ply with a cellulose content that is 100% cellulose from a paper furnish. In some embodiments, a paperboard product with at least one ply that has a cellulose content of about 5% to about 20% by weight refined cellulose and about 80% to about 95% cellulose from a paper furnish, and containing a bond strengthening agent can have a basis weight that is about the same (e.g., from about 90% to about 110%, or about 98% to about 105%), a bending stiffness that is at least 115% (e.g., at least 120%, or at least 125%) and/or compressive resistance of at least 110% (e.g., at least 115%, or at least 120%), and a caliper of at least 105% the thickness (e.g., at least 107%, or at least 110%) of a control paperboard having a single ply with a cellulose content that is 100% cellulose from the same paper furnish.

In some embodiments, a ply having a cellulose content of about 5% to about 20% by weight refined cellulose is foam formed. A foam formed ply typically includes an air content of about 30% to about 70% by volume of the ply. A foam formed ply can also include a foaming agent, such as ammonium lauryl sulfate, sodium lauryl sulfate, alkyl-ether sulfates, sodium laureth sulfate, alkyl polyethylene glycol ethers, sodium myreth sulfate, or sodium dodecyl sulfate. A foam formed ply can be made using available methods, such as those found in international patent publication nos. WO 2013/160564 and WO 2013/160553, which are incorporated by reference herein. In some embodiments, additional plies of a paperboard product provided herein can be foam formed.

A paperboard product provided herein can also be coated on one or both sides. Suitable coatings include a polyelectrolyte complex, such as starch (e.g., cationic starches), carboxymethyl cellulose, polyacrylamides, polyamideamine epichlorohydrin, polyallylamin hydrochloride, or a combination thereof.

A paperboard product provided herein can be made using known paperboard making methods, such as the use of a Fourdrinier Machine or Cylinder Machine, or variations thereof, pressing equipment, drying equipment, and calendering equipment. For example, paper furnish or paper furnish with refined cellulose can be deposited from a head box onto a mesh conveyor to form a web of cellulose fibers on the conveyor that is drained, pressed, heat dried and calendered to form a paperboard ply. In some embodiments, one or more additional webs of cellulose are layered on top of one or more drained webs, which are then pressed, heat dried, and calendered to form a multiply paperboard product. Each cellulose web is typically formed from a paper furnish or paper furnish with refined cellulose deposited from a separate head box to form individual plies.

In some embodiments, paper furnish or paper furnish with refined cellulose is foamed. Paper furnish or paper furnish with refined cellulose can be foamed using any appropriate technology, such as agitation or aeration of a paper furnish (with or without a refined cellulose) including a foaming agent to incorporate air into the paper furnish. Suitable methods producing a foam formed cellulose web can be found in international patent publication nos. WO 2013/160564 and WO 2013/160553. A foam formed web of cellulose can then be deposited on to the mesh conveyor.

Cellulose webs are typically drained by allowing water to pass through the mesh conveyor. In some embodiments, webs are further drained using vacuum suction, such as from a suction roll.

Pressing of a cellulose web typically involves directing one or more layers of cellulose webs on or between press felts between two or more cylinders. The cylinders press the one or more layers of cellulose webs to facilitate additional water removal by the press felts and control the thickness of the one or more webs. Pressure applied between the two or more cylinders can be adjusted as appropriate to result in a desired thickness (i.e., caliper) and/or basis weight of a paperboard product. Decreasing the applied pressure can result in a larger caliper and/or reduced basis weight of a paperboard product. Increasing the applied pressure ca result in a lower caliper and/or increased basis weight of a paperboard product. In some embodiments, pressure applied by pressing cylinders can be adjusted in order to retain void spaces in a foam formed web of cellulose.

In some embodiments, a polyelectrolyte complex can be applied to one or both surfaces of a cellulose web, or an outer surface of an outer cellulose web layer, prior to pressing. A polyelectrolyte complex can be applied using any appropriate technology, such as spraying one or more components onto the surface of a cellulose web.

Following pressing, cellulose webs are typically dried by passing the webs around heated cylinders, through heated air, and/or past infrared heaters.

In some embodiments, additional sizing agents or fillers (e.g., calcium carbonate or china clay) can be applied to one or more surface of a cellulose web following drying and prior to calendering.

Calendering typically includes directing a cellulose web between two or more cylinders where pressure is applied. Calenders can facilitate uniform thickness of the resulting paperboard and/or provide a desired finish to the surface of the paperboard.

The following examples are provided to illustrate particular embodiments of the invention.

EXAMPLES

Example 1

Figure 2:
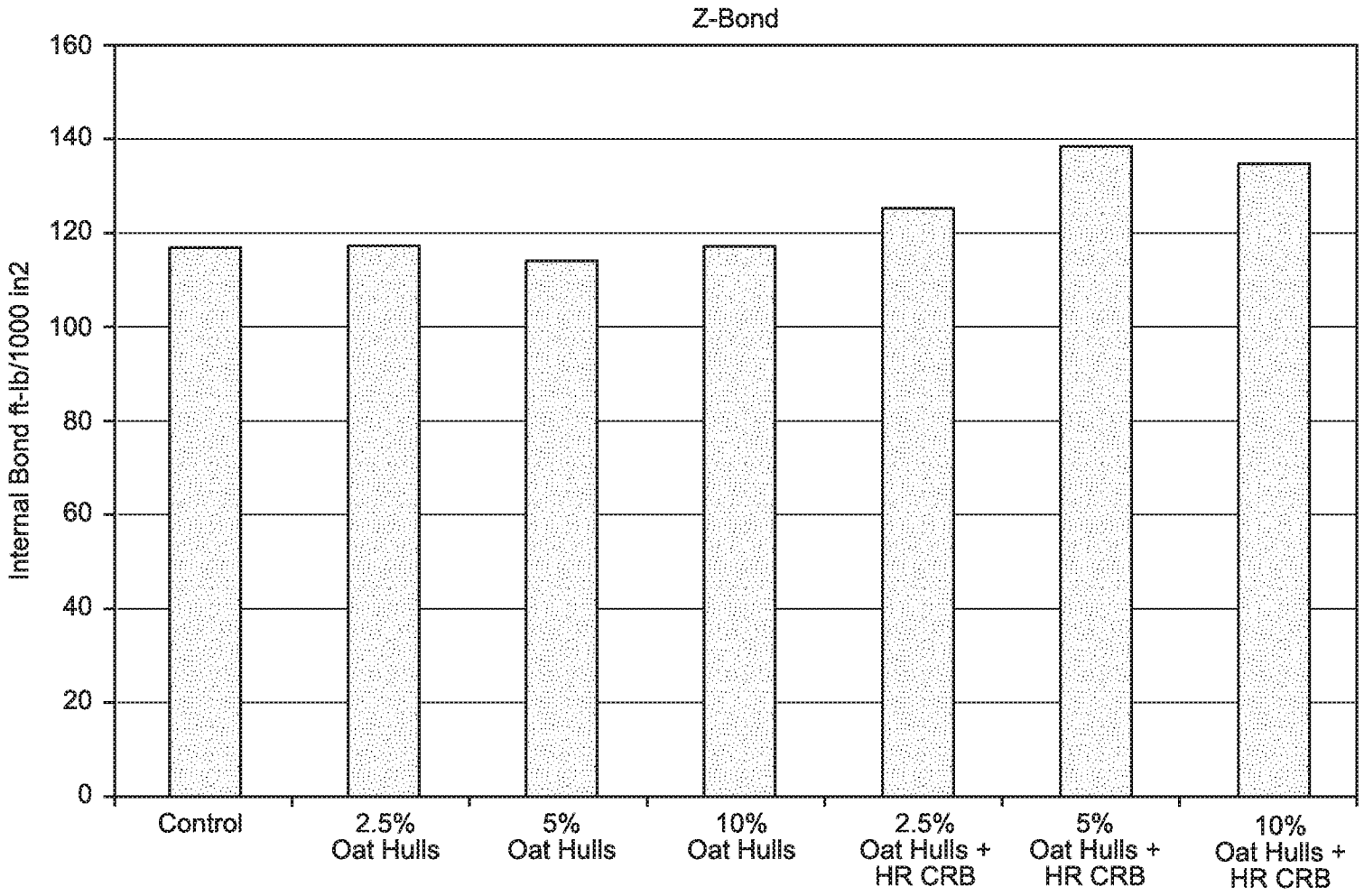
FIG. 2 shows internal fiber bond strength (i.e., z-bond), as measured using the z-directional tensile test of paperboard samples including refined cellulose as compared to a control that does not include refined cellulose.
Figure 3:
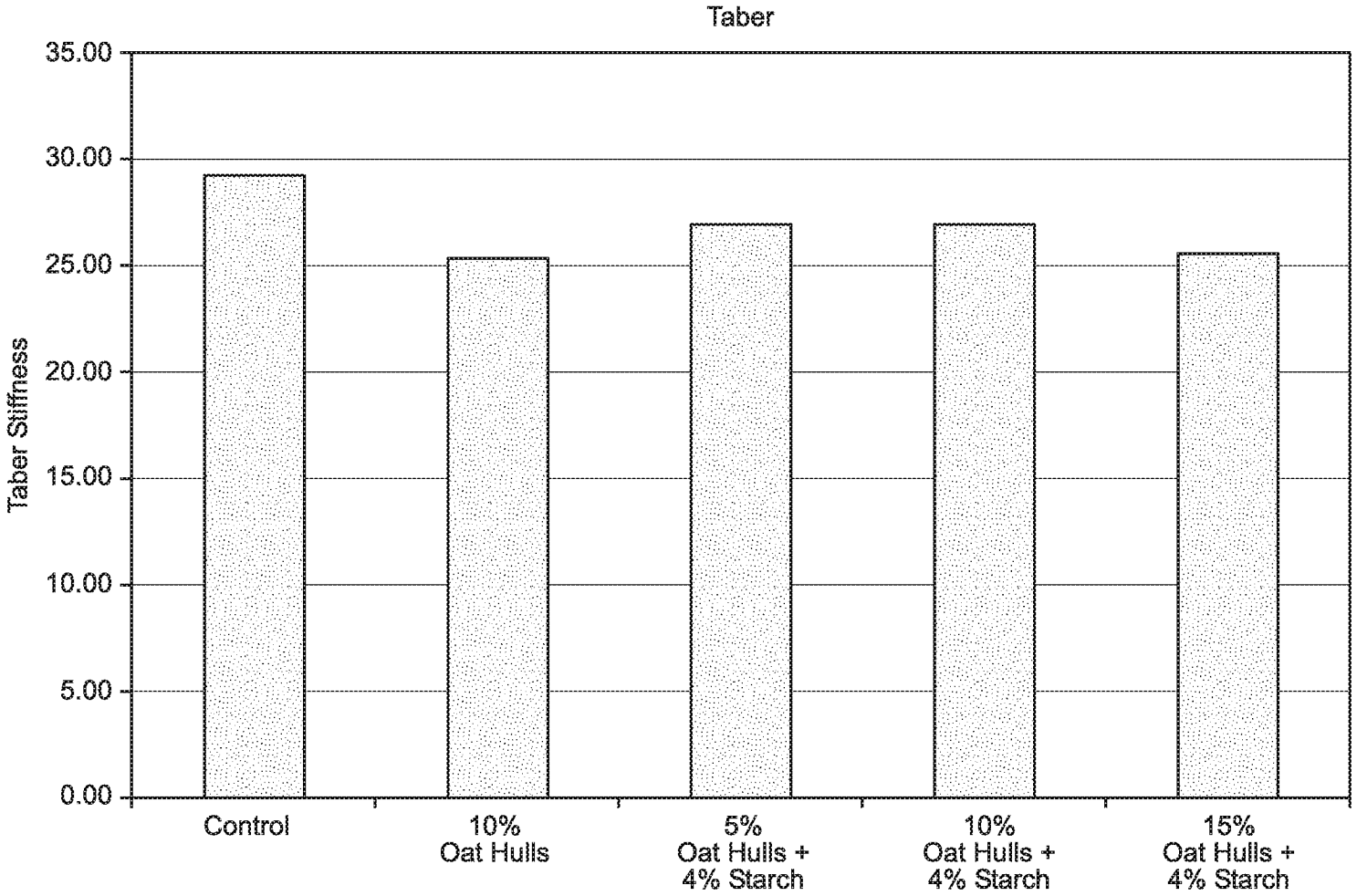
FIG. 3 shows bending stiffness measured by Taber Stiffness of paperboard samples including refined cellulose as compared to a control that does not include refined cellulose.

Cellulose suspensions comprising CRB furnish or CRB furnish plus refined cellulose were made according to Table 1 (for FIGS. 1 and 2) or Table 2 (for FIGS. 3-6), where "HR CRB" is highly refined wood cellulose from CRB furnish and "Oat Hulls" is refined oat hulls. The suspensions were each used to produce a paperboard product with a single ply. Briefly, each cellulose suspension was formed into a single ply paperboard using a Fourdrinier Machine with the head box configured to meter cellulose content at a rate of 165 g per square meter (gsm) or 180 gsm and pressure of the pressing cylinders set at 5.5 to 6.5 bar. Caliper of the paperboard was not standardized during calendering.

TABLE 1

| Sample (165 gsm) | % cellulose content from CRB furnish | Refined Oat Hulls (% cellulose content) | Bond Strengthening Agent (HR CRB as % cellulose content) |
|---|---|---|---|
| Control | 100% | 0% | 0% |
| 2.5% Oat Hulls | 97.5% | 2.5% | 0% |
| 5% Oat Hulls | 95% | 5% | 0% |
| 10% Oat Hulls | 90% | 10% | 0% |
| 2.5% Oat Hulls + HR CRB | 97.5% | 1.88% | 0.63% |
| 5% Oat Hulls + HR CRB | 95% | 3.75% | 1.25% |
| 10% Oat Hulls + CRB | 90% | 7.5% | 2.5% |

| Sample (180 gsm) | % cellulose content from CRB furnish | Refined Oat Hulls (% cellulose content) | Bond Strengthening Agent (cationic starch as % dry weight) |
|---|---|---|---|
| Control | 100% | 0% | 0% |
| 10% Oat Hulls | 97.5% | 2.5% | 0% |
| 5% Oat Hulls + 4% Starch | 95% | 5% | 4% |
| 10% Oat Hulls + 4% Starch | 90% | 10% | 4% |
| 15% Oat Hulls + 4% Starch | 85% | 15% | 4% |

Figure 4:
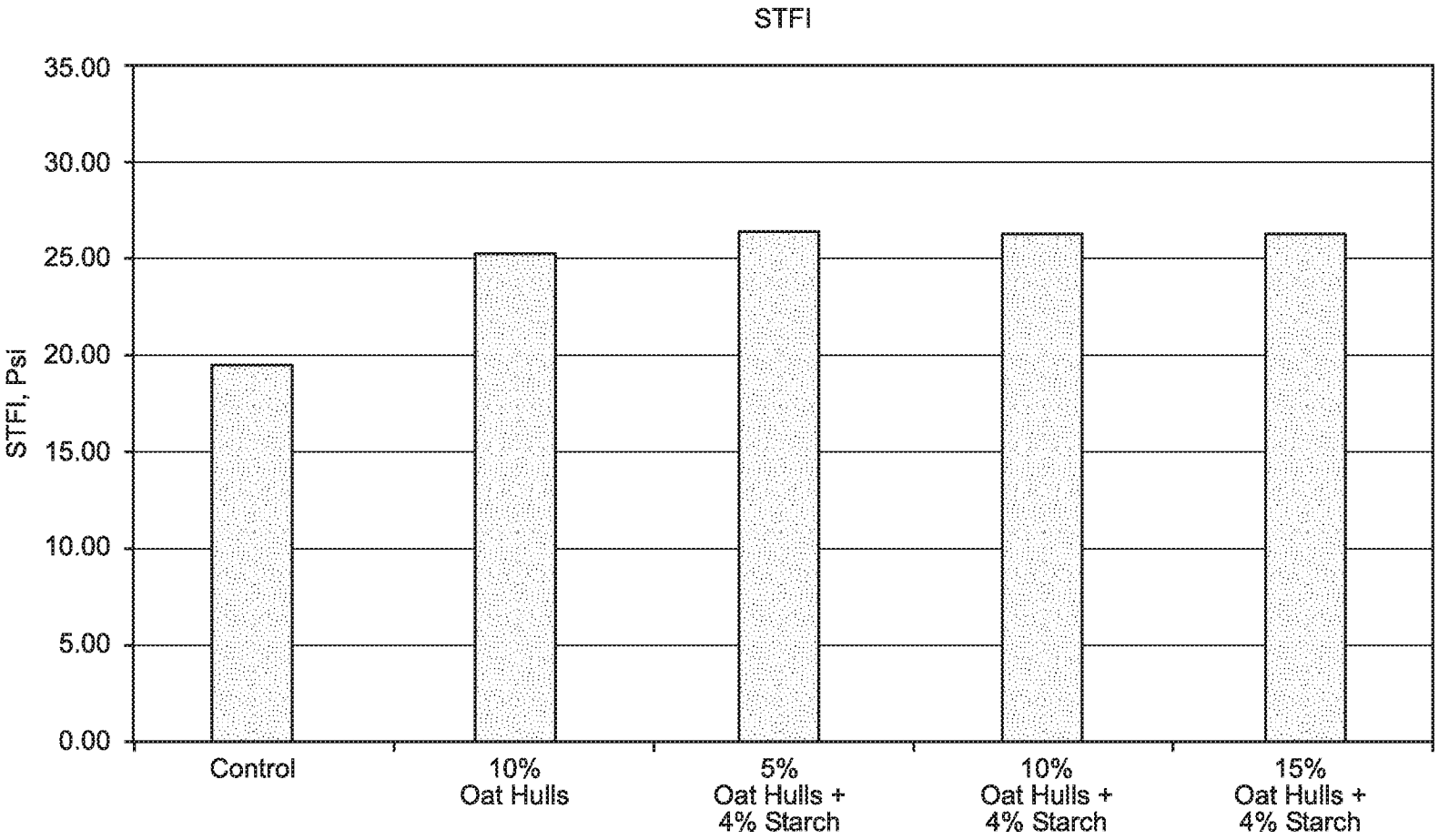
FIG. 4 shows compressive resistance measured by STFI edgewise strength test of paperboard samples including refined cellulose as compared to a control that does not include refined cellulose.
Figure 5:
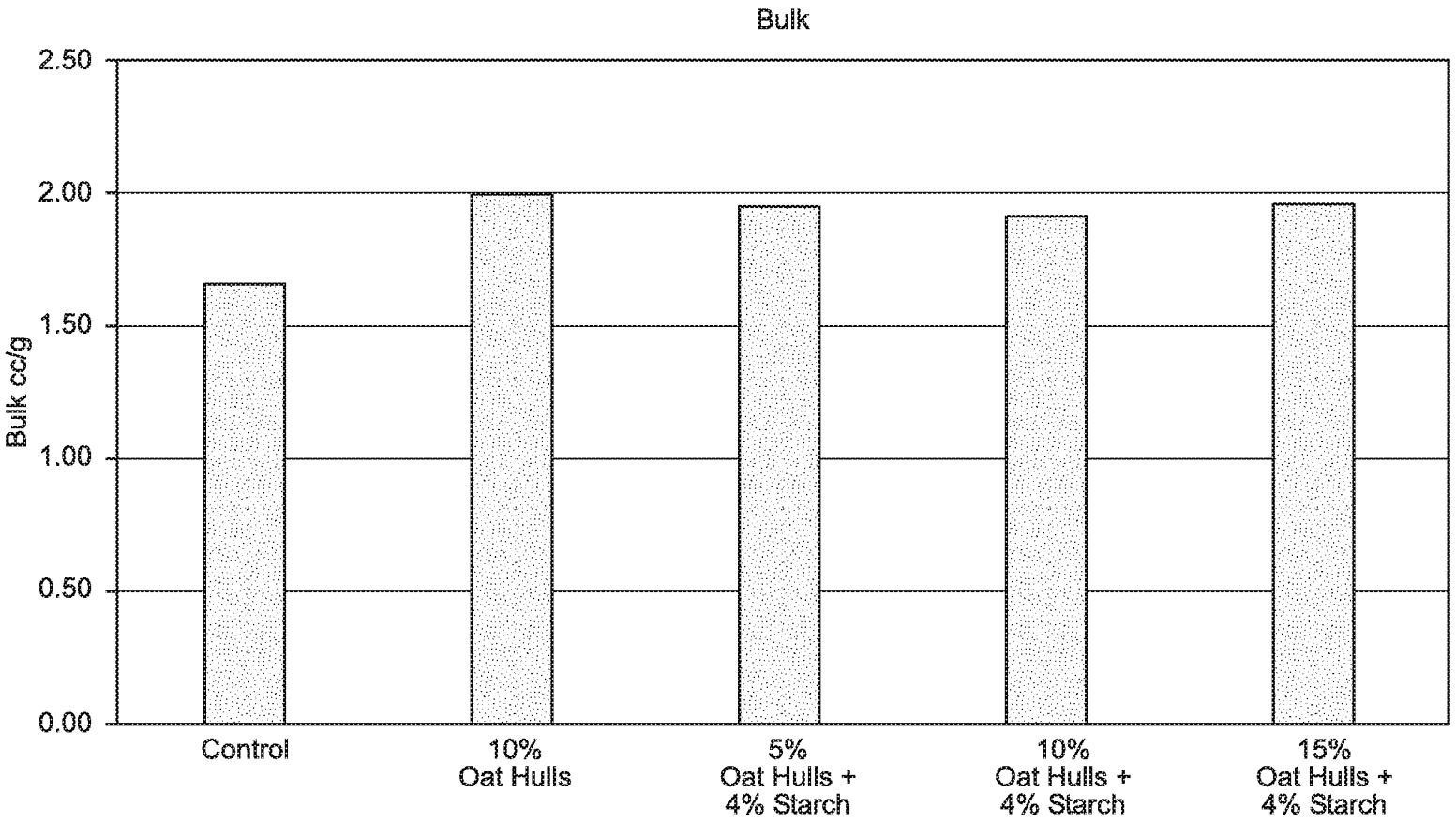
FIG. 5 shows bulk of paperboard samples including refined cellulose as compared to a control that does not include refined cellulose.
Figure 6:
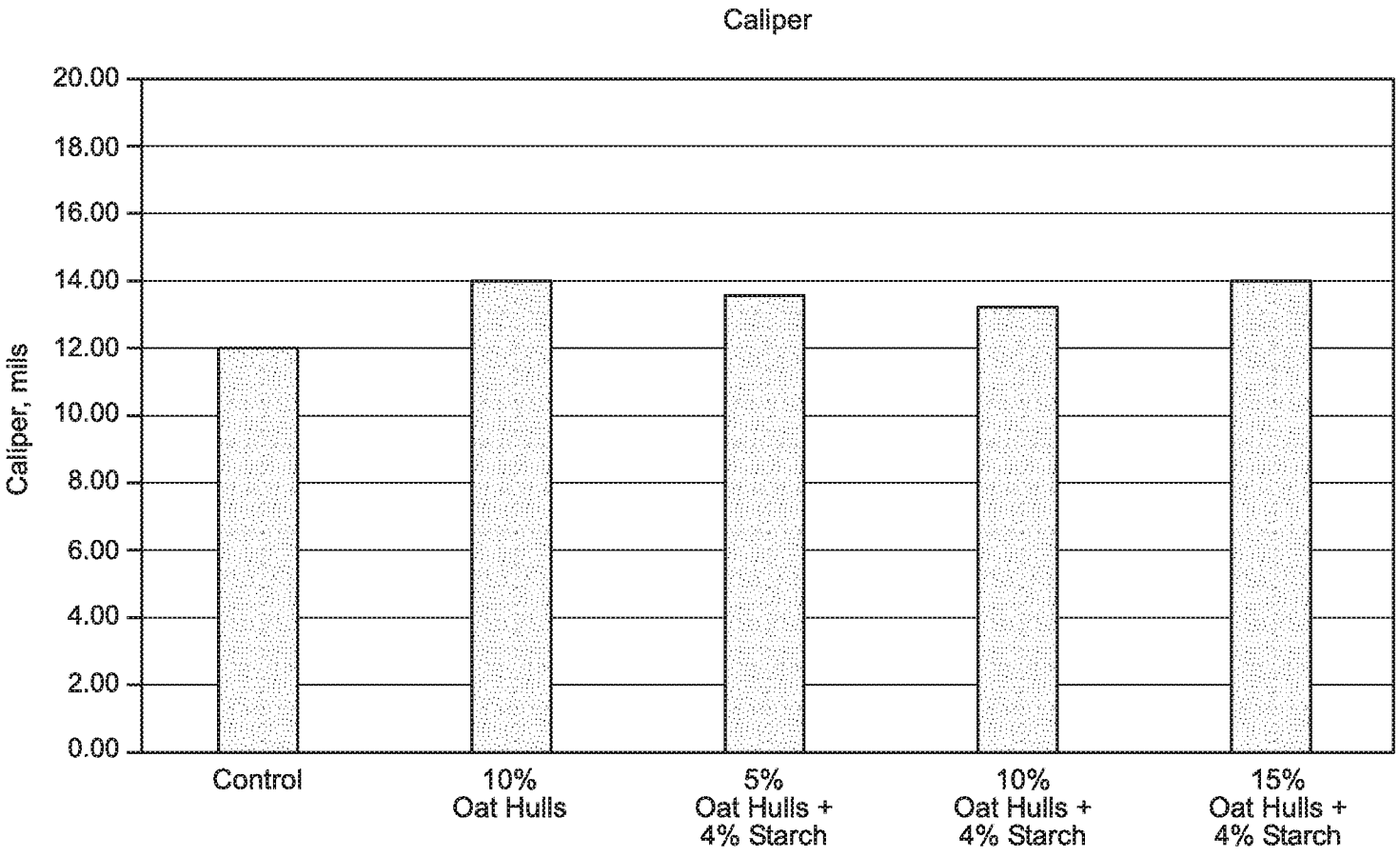
FIG. 6 shows caliper of paperboard samples including refined cellulose as compared to a control that does not include refined cellulose.

As shown in FIGS. 1-6, the addition of refined oat hulls with a bond strengthening agent (highly refined wood cellulose or starch) resulted in a paperboard product that has similar (e.g., at least 90%) or increased bending stiffness (FIGS. 1 and 3) as measured using a Taber Stiffness Tester, similar or increased compressive resistance (FIG. 4) as measured by STFI edgewise strength test, and similar or increased caliper (FIG. 6), while having a reduced basis weight (shown in FIG. 5 as increased bulk density). In similar experiments using refined oat hulls and highly refined wood cellulose as a bond strengthening agent, it was found that a combination of about 10-15% refined oat hull and about 5% highly refined wood cellulose provided a good combination of bending stiffness and drainage during production.

The STFI edgewise strength test was measured using Technical Association of the Pulp and Paper Industry (TAPPI) standard 826. Briefly, the STFI edgewise strength test was performed by attaching a clamp to each end of a test strip of paperboard to be tested and moving the clamps toward one another. The stress in kPa/GSM or Lbft/1000 $in^2$ at the point of rupture of the test strip was recorded as the STFI edgewise strength. The STFI edgewise strength test tests the edgewise compressive strength of the paper and is designed to characterize a paperboard's resistance to compressive forces.

Taber stiffness was measured using TAPPI standard 489. Briefly, Taber stiffness was measured by clamping one end of a test strip of paperboard to be tested to a fixed point and the other to a pendulum arm that is rotatable around the fixed point. The test strip was forced to bend by rotating the end affixed to the pendulum from 0° (unbent) to −15°, back to 0°, and then to 15°. The resistance from 0° to −15° and the resistance from 0° to 15° in Taber units were averaged to arrive at the Taber stiffness. Taber stiffness is designed to measure bending modulus of elasticity.

In some cases, addition of a refined cellulose increased internal fiber bond strength (i.e., z-bond), as measured using the z-directional tensile test and shown in FIG. 4. The z-directional tensile test was performed using TAPPI standard 541. Briefly, z-bond was measured by affixing a piece of paperboard with double sided tape to two parallel platens, where one platen was in a fixed position and the other platen was vertically mobile. The mobile platen was moved upward from the fixed platen to measure the maximum tensile stress that the paperboard can withstand when loaded perpendicularly to the plane of the paperboard until delamination. Z-directional tensile strength was then recorded in kPa/GSM or Lbft/1000 $in^2$.

Example 2

Figure 7:
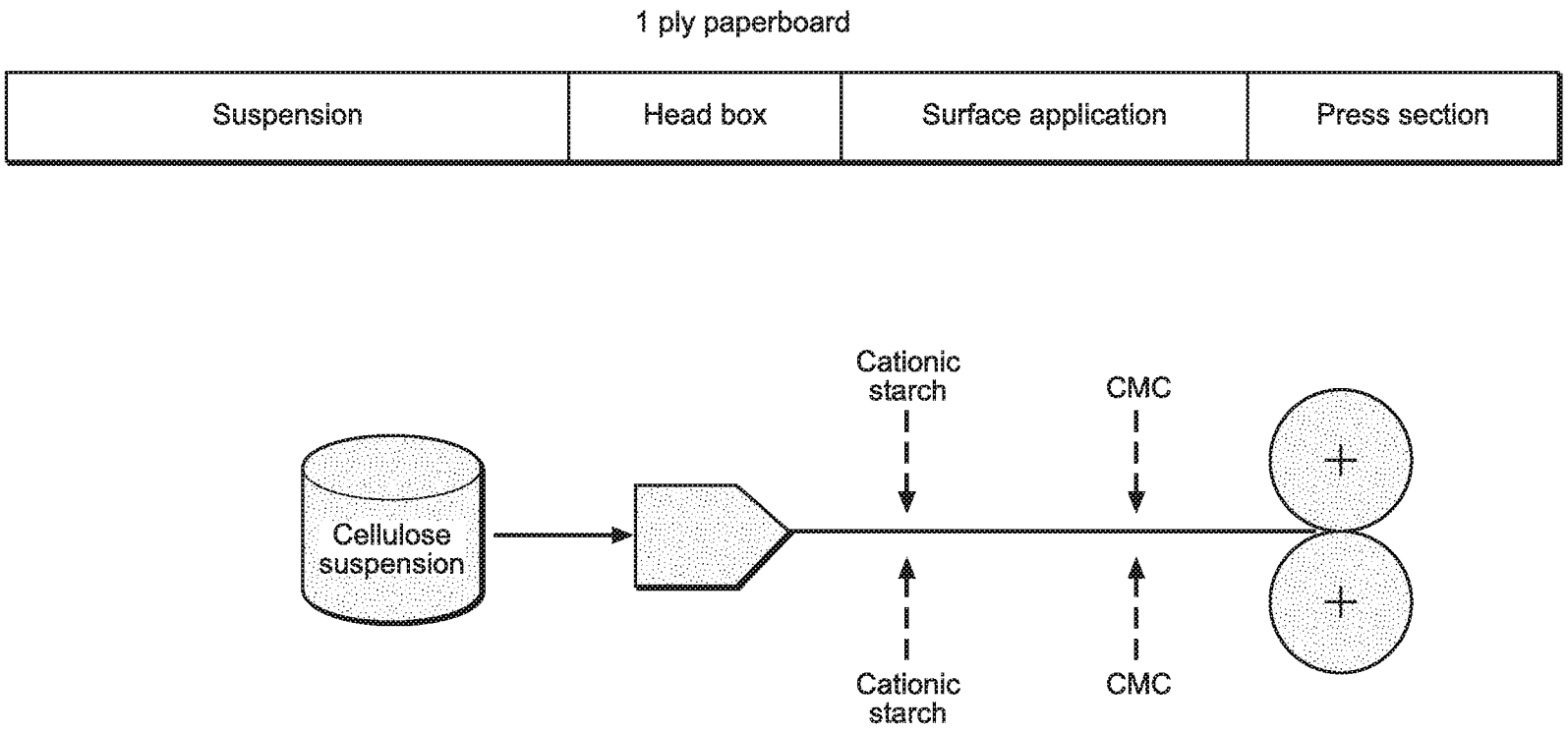
FIG. 7 shows a schematic of a method of making a paperboard ply.
Figure 8:
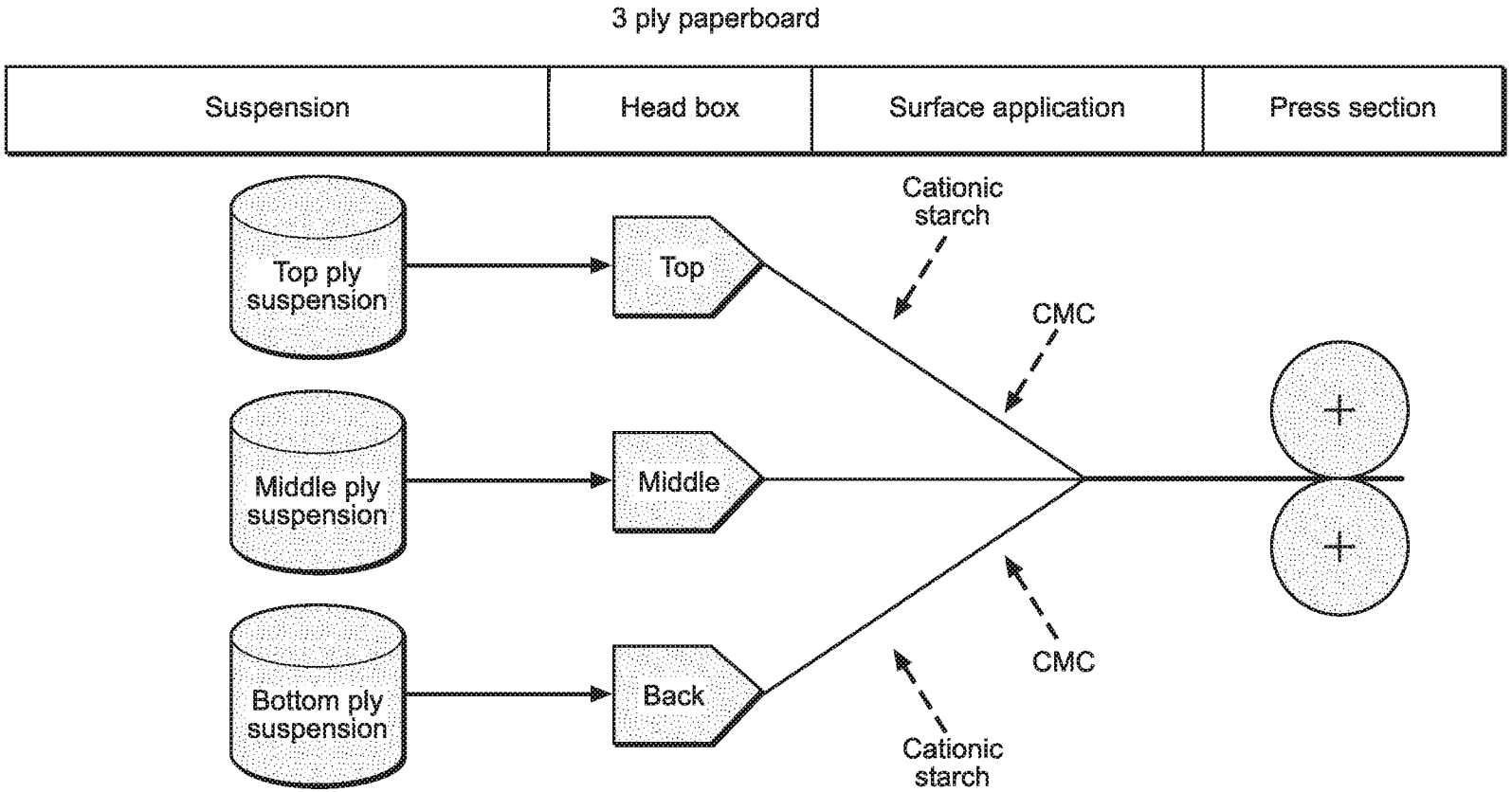
FIG. 8 shows a schematic of a method of making a 3 ply paperboard product.

Paperboard samples were made, each including 1 or 3 plies made with a CRB suspension or a CRB suspension and highly refined wood cellulose (HR CRB) according, to Table 3. Suspensions used to make paperboard products C-K were foamed using sodium dodecyl sulfate as a foaming agent and used to produce a paperboard product with 1 to 3 plies as shown in Table 3 and FIGS. 7 and 8. Suspensions used to make control paperboard products A and B did not include a foaming agent and were not foamed. The outer surfaces of paperboard products D-E and G-K were sprayed with a 2% solution of cationic starch and a 2% solution of carboxymethyl cellulose prior to pressing. The outer surfaces of paperboard product F was sprayed with a 4% solution of cationic starch and a 4% solution of carboxymethyl cellulose prior to pressing. The pressing cylinder pressure was set from 1 bar to 2 bars, as shown in Table 3. Where 3 plies were included, the middle ply contributed about 49.2 lbs/1000 $ft^2$ to the basis weight and the top and bottom plies contributed about 12.3 lbs/1000 $ft^2$ per ply to the basis weight.

Figure 9:
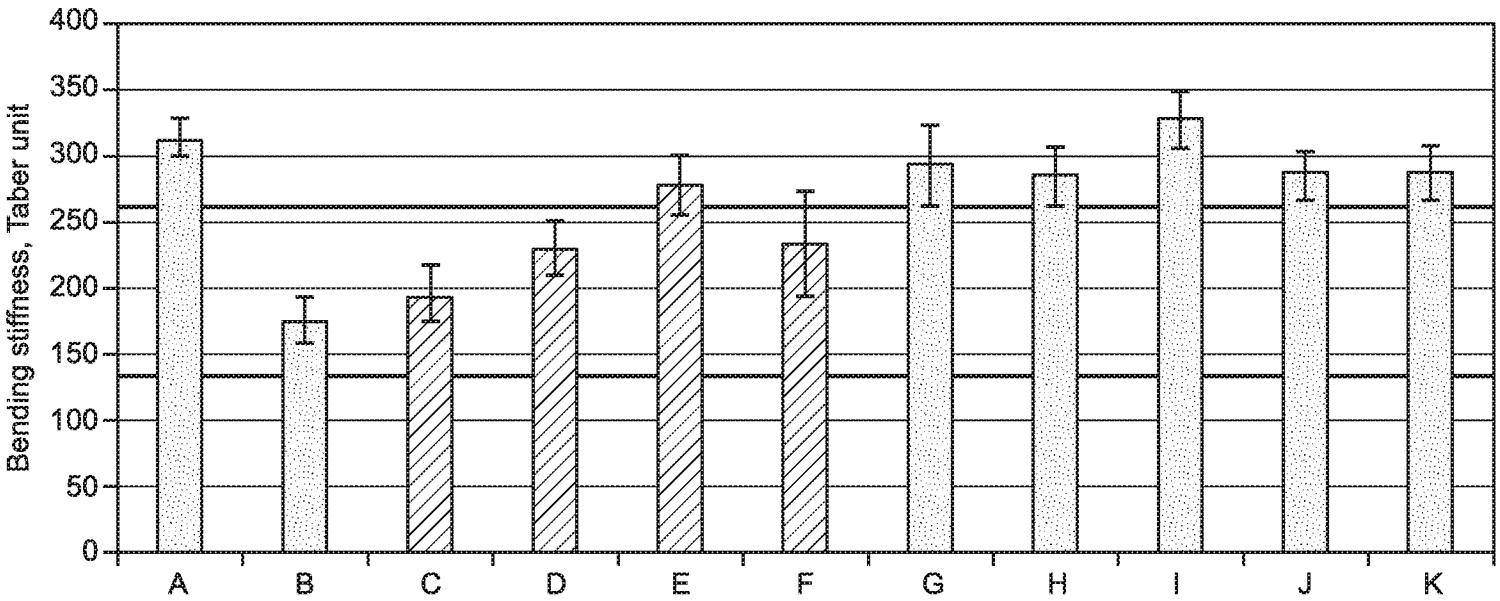
FIG. 9 shows bending stiffness measured by Taber Stiffness of paperboard samples including refined cellulose as compared to controls that do not include refined cellulose.

As shown in FIG. 9 and Table 3, when the basis weight of a control paperboard that does not include a refined cellulose (Sample A) was reduced by 20% to produce Sample B without any further changes, bending stiffness was reduced by more than 40%. Some of the bending stiffness could be recovered by foaming the furnish (Sample C). Additional strength could be recovered by including a surface spray of cationic starch and carboxymethyl cellulose (Samples D-F), increasing ply thickness by decreasing pressing cylinder pressure (Sample E), and/or adding additional bond strengthening agent to the furnish (Sample F). However, addition of 10% highly refined CRB to a single ply resulted in a paperboard with a 20% reduced basis weight, yet retaining a bending stiffness similar to the control Sample A, while also including 25% less cationic starch (compare Samples A and E, each containing 100% CRB furnish and 4% cationic starch to Samples G and H, each containing 10% HR CRB and 3% cationic starch). Paperboards made with either 2 or 3 plies that included refined cellulose (Samples I-K) had a basis weight that was 20% lower than control Sample A, yet retained at least about 85% of the bending stiffness, even with no cationic starch included in the middle ply (Sample K).

TABLE 3

| Sample | A | B | C | D | E | F | G | H | I | J | K |
|---|---|---|---|---|---|---|---|---|---|---|---|
| Basis weight (lbs/1000 $ft^2$) | 92.3 | 74 | 74 | 74 | 74 | 74 | 74 | 73.8 | 73.8 | 73.8 | 73.8 |
| Pressing cylinder pressure (bars) | 3.6 | 3.6 | 2 | 2 | 1 | 2 | 1 | 1.5 | 1 | 1 | 1 |
| Single ply or Middle ply for multi-ply samples | | | | | | | | | | | |
| Cellulose suspension | 100% CRB | 100% CRB | 100% CRB | 100% CRB | 100% CRB | 100% CRB | 90% CRB 10% HR CRB | 90% CRB 10% HR CRB | 100% CRB | 90% CRB 10% HR CRB | 90% CRB 10% HR CRB |
| Cationic starch | 4% | 4% | 4% | 4% | 4% | 8% | 3% | 3% | 3% | 3% | 0% |
| Top ply and bottom ply | | | | | | | | | | | |
| Cellulose suspension | NA | NA | NA | NA | NA | NA | NA | NA | 90% CRB 10% HR CRB | 90% CRB 10% HR CRB | 90% CRB 10% HR CRB |
| Cationic starch | NA | NA | NA | NA | NA | NA | NA | NA | 3% | 3% | 3% |

The implementations described above and other implementations are within the scope of the following claims. One skilled in the art will appreciate that the present disclosure can be practiced with embodiments other than those disclosed. The disclosed embodiments are presented for purposes of illustration and not limitation.

What is claimed is:

1. A method of making a paperboard product, comprising:

a. depositing a layer of a suspension of cellulose fibers, the suspension including a bond strengthening agent and having a cellulose content of about 80% to about 95% cellulose from a paper and/or recycled furnish and about 5% to about 20% refined cellulose; and b. applying pressure to the layer to form at least 1 ply of a paperboard product having 1 or more plies, wherein the paperboard product has:

a basis weight reduction of 5% to 30% or a basis weight of about 90% to about 110% of a control paperboard having a single ply with a cellulose content that is 100% cellulose from the paper furnish;

a bending stiffness of at least 90% of the control paperboard having a single ply with a cellulose content that is 100% cellulose from the paper furnish; and a thickness of about 90% to about 110% of the control paperboard having a single ply with a cellulose content that is 100% cellulose from the paper furnish; and wherein either:

refined oat hulls are included in the at least 1 ply in an amount of about 5% to about 15% of the cellulose content of the at least 1 ply; or the refined cellulose is refined oat hulls and the bond strengthening agent is highly refined wood cellulose in a 3:1 to 4:1 ratio of refined oat hulls to highly refined cellulose.

2. The method of claim 1, wherein the bending stiffness is at least 115% of the control paperboard.

3. The method of claim 2, wherein the thickness is about 95% to about 105% of the control paperboard having the single ply with the cellulose content that is 100% from the paper furnish.

4. The method of claim 1, wherein the bond strengthening agent comprises a non-cellulose polymer.

5. The method of claim 1, wherein the paperboard product is coated with a polyelectrolyte complex.

6. The method of claim 1, wherein refined oat hulls are included in the at least 1 ply in an amount of about 5% to about 15% of the cellulose content of the at least 1 ply.

7. The method of claim 1, wherein the refined cellulose is refined oat hulls and the bond strengthening agent is the highly refined wood cellulose in a 3:1 to 4:1 ratio of refined oat hulls to highly refined cellulose.

* * * * *